US006193769B1

(12) United States Patent
Dakin et al.

(10) Patent No.: US 6,193,769 B1
(45) **Date of Patent: *Feb. 27, 2001**

(54) FUEL CELL FOR CHAFING DISHES

(75) Inventors: Eugene Scott Dakin; Joyce Roberta Cahill, both of Edmonton (CA)

(73) Assignee: Smithlite Lamp Co., Ltd., Edmonton (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/169,063

(22) Filed: Oct. 9, 1998

(30) Foreign Application Priority Data

Aug. 24, 1998 (CA) ..... 2245391

(51) Int. Cl.[7] ..... C10L 11/00; F23D 3/02
(52) U.S. Cl. ..... 44/519; 44/445; 431/320
(58) Field of Search ..... 44/519; 431/320

(56) References Cited

U.S. PATENT DOCUMENTS

| | | | | |
|---|---|---|---|---|
| 3,754,877 | * | 8/1973 | Klug | 44/267 |
| 4,251,670 | | 2/1981 | Cummings | 560/169 |
| 4,624,633 | * | 11/1986 | Bandel | 431/320 |
| 4,725,225 | * | 2/1988 | Gravitt | 431/320 |
| 5,584,283 | * | 12/1996 | Messina | 126/43 |
| 5,591,395 | * | 1/1997 | Schroeder et al. | 422/4 |
| 5,785,513 | * | 7/1998 | Kiefer et al. | 431/320 |
| 5,858,031 | * | 1/1999 | Perlman | 44/452 |
| 5,904,476 | * | 5/1999 | Hoffman | 431/320 |
| 6,035,847 | * | 3/2000 | Paul | 431/320 |

FOREIGN PATENT DOCUMENTS

| | | | |
|---|---|---|---|
| WO94/02436 | 2/1994 | (WO) | C06B/45/10 |

OTHER PUBLICATIONS

Product Information on Tetraethylene Glycol and Propylene Glycol, 6 pages, undated.
Union Carbide Material Safety Data Sheet, Diethylene Glycol, Apr. 13, 1995, 8 pages.
ARCO Chemical Company Material Safety Data Sheet, Propylene Glycol Industrial, Feb., 1998, 12 pages.

* cited by examiner

*Primary Examiner*—Ellen M. McAvoy
(74) *Attorney, Agent, or Firm*—Davis and Bujold

(57) ABSTRACT

A fuel cell for use in chafing dishes includes a container with a combustible medium in the container. The combustible medium is primarily propylene glycol. The advantage of such a fuel cell is that it is non-toxic.

2 Claims, 1 Drawing Sheet

FUEL CELL FOR CHAFING DISHES

FIELD OF THE INVENTION

The present invention relates to a fuel cell for use with chafing dishes.

BACKGROUND OF THE INVENTION

Restaurants which feature hot buffet meals, use chafing dishes to keep their food hot. Each chafing dish has a diethylene glycol fuel cell which provides an open heating flame. Unfortunately, it has been determined that byproducts produced from the burning of diethylene glycol are toxic to humans. Studies are presently being undertaken regarding the severity of the health risk to determine whether diethylene glycol should be banned or whether the risk can be managed with enhanced ventilation where the chafing dishes are located. The material safety data sheet that accompanies diethylene glycol fuel cells contains an extensive list of potential hazards.

SUMMARY OF THE INVENTION

What is required is an alternative form of fuel cell for use with chafing dishes.

According to the present invention there is provided a fuel cell includes a container with a combustible medium in the container consists of at least 50% propylene glycol.

As a result of an extensive search for an alternative to diethylene glycol, the inventor has determined that an ideal non-toxic fuel for use in a chafing dish fuel cell is pure propylene glycol. The quantity of propylene glycol used depends upon whether the intention is to reduce toxic vapours from the burning of the combustible medium to acceptable levels or to the greatest extent possible eliminate such a safety hazard altogether. The reduction of the safety hazard requires that there be at least 50% propylene glycol by volume. The elimination of the safety hazard requires that substantially pure propylene glycol be used. The propylene glycol that is commercially available is generally 90% or higher in purity. A practical approach that is preferred is to use at least 75% propylene glycol.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
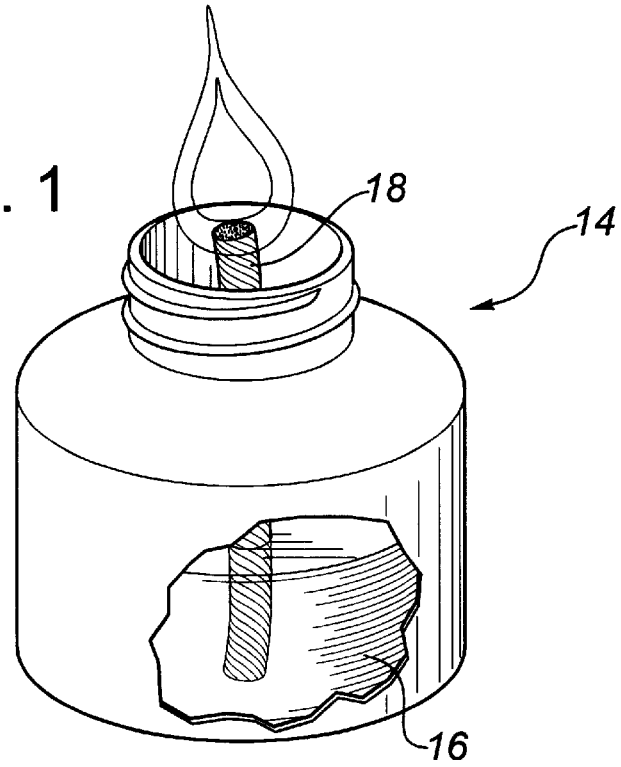
FIG. 1 is a partially cut away perspective view of a fuel cell for a chafing dish in accordance with the teachings of the present invention.

The preferred embodiment, a fuel cell for use with chafing dishes, will now be described with reference to FIGS. 1 and 2.

Figure 2:
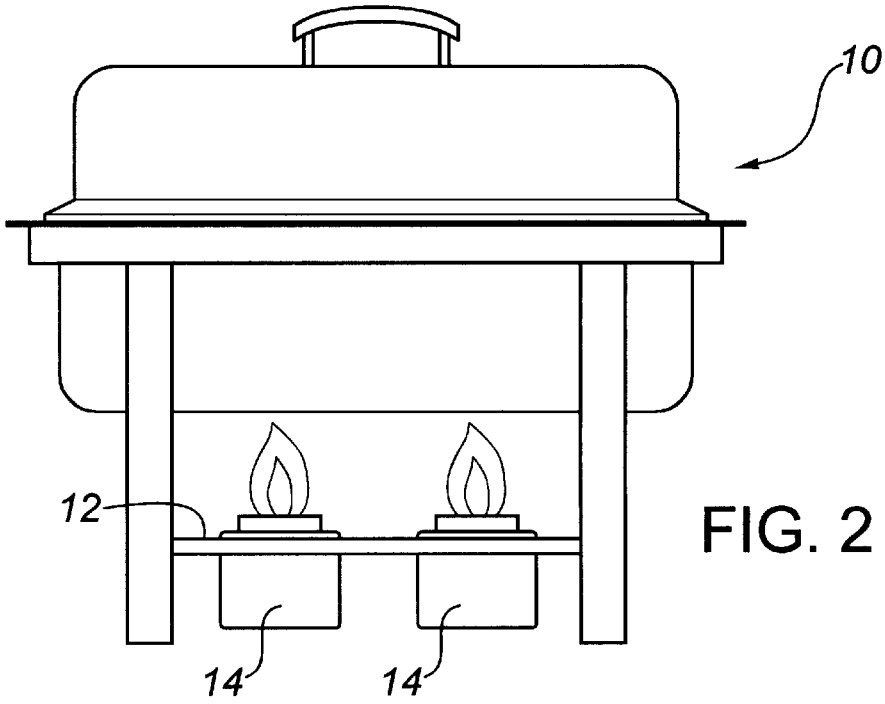
FIG. 2 is a side elevation view of the fuel cell illustrated in FIG. 1, in combination with a chafing dish.

Referring to FIG. 2, there is illustrated a chafing dish 10 having an underlying fuel cell cavity 12. Containers 14 are positioned in cavity 12. Referring to FIG. 1, container 14 holds a combustible medium 16. Combustible medium 16 consists primarily of propylene glycol. A wick 18 is provided to aid in igniting keeping burning the propylene glycol.

Propylene glycol is believed to be an ideal non-toxic fuel and, as such, is well suited for use with chafing dishes.

Propylene glycol is a solvent and oxidizer that can be ingested without harmful side effects. Due to these known properties it is presently used extensively in the pharmaceutical and food industries. Its properties as a non-toxic fuel source are not believed to have been previously known. Propylene glycol is not always commercially available in an absolutely pure form, but can be readily obtained in a substantially pure form which has not less than 90% propylene glycol. Beneficial results may be obtained through a substantially pure form of propylene glycol, notwithstanding the presence of some impurities. Of course, even substantial impurities do not pose a problem if they are inert non-toxic filler materials. Eventually, other suitable non-toxic combustible medium will be discovered. When that occurs propylene glycol may be mixed with such other non-toxic combustible medium and the resulting mixture will still be non-toxic. The quantity of propylene glycol used depends upon whether the intention is to reduce toxic vapours from the burning of the combustible medium to acceptable levels or to the greatest extent possible eliminate such a safety hazard altogether. The reduction of the safety hazard requires that there be at least 50% propylene glycol by volume. The elimination of the safety hazard requires that substantially pure propylene glycol be used. The propylene glycol that is commercially available is generally 90% or higher in purity. A practical approach that is preferred is to use at least 75% propylene glycol.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of using a non-toxic fuel cell to heat a food item located in a chafing dish, the method comprising the steps of:

providing a chafing dish having an underlying fuel cell cavity;

filling a container, opened at one end, with a non-toxic combustible medium consisting essentially of pure propylene glycol;

embedding a wick within the non-toxic combustible medium consisting essentially of pure propylene glycol and at least partially extending the wick out through the opened end of the container to facilitate igniting the wick and combustion of the non-toxic combustible medium consisting essentially of pure propylene glycol within the container;

placing the container with the non-toxic combustible medium consisting essentially of pure propylene glycol in the at least one underlying fuel cell cavity; and igniting the wick to burn the non-toxic combustible medium consisting essentially of pure propylene glycol and heat the food item located in the chafing dish.

2. A method of using a non-toxic fuel cell to heat a food item located in a chafing dish, the method comprising the steps of:

providing a chafing dish having a pair of underlying fuel cell cavities;

filling a pair of container, each opened at one end, with a non-toxic combustible medium consisting essentially of substantially pure propylene glycol;

embedding a wick within the non-toxic combustible medium consisting essentially of pure propylene glycol of each container and at least partially extending the wick out through the opened end of each container to facilitate igniting the wick and combustion of the non-toxic combustible medium consisting essentially of pure propylene glycol within the container;

placing one of the pair of containers, with the non-toxic combustible medium consisting essentially of pure propylene glycol, in each of the underlying fuel cell cavities; and igniting the wicks of the pair of containers to burn the non-toxic combustible medium consisting essentially of pure propylene glycol and heat the food item located in the chafing dish.

* * * * *